US008136920B2

(12) United States Patent
Sakurai et al.

(10) Patent No.: US 8,136,920 B2
(45) Date of Patent: Mar. 20, 2012

(54) NOZZLE PLATE, METHOD FOR MANUFACTURING NOZZLE PLATE, DROPLET DISCHARGE HEAD, AND DROPLET DISCHARGE APPARATUS

(75) Inventors: Naoaki Sakurai, Kanagawa-ken (JP); Junsei Yamabe, Kanagawa-ken (JP); Hiroshi Koizumi, Kanagawa-ken (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 829 days.

(21) Appl. No.: 11/962,912

(22) Filed: Dec. 21, 2007

(65) Prior Publication Data

US 2008/0211871 A1 Sep. 4, 2008

(30) Foreign Application Priority Data

Dec. 26, 2006 (JP) ..... 2006-350146

(51) Int. Cl.
*B41J 2/14* (2006.01)
*B41J 2/16* (2006.01)

(52) U.S. Cl. ..... 347/47; 347/71

(58) Field of Classification Search ..... 347/5, 9, 347/12, 29, 41, 45–47, 64, 67, 71, 83
See application file for complete search history.

(56) References Cited

U.S. PATENT DOCUMENTS

| | | | | |
|---|---|---|---|---|
| 6,155,670 | A * | 12/2000 | Weber et al. | 347/43 |
| 2008/0111854 | A1 * | 5/2008 | Laffay et al. | 347/45 |

FOREIGN PATENT DOCUMENTS

| | | | |
|---|---|---|---|
| CN | 1272818 | A | 11/2000 |
| CN | 2736166 | Y | 10/2005 |
| JP | 9-216368 | | 8/1997 |
| JP | 2001-212966 | | 8/2001 |
| JP | 2003-266394 | | 9/2003 |
| JP | 2004-209707 | | 7/2004 |
| JP | 2004-237448 | | 8/2004 |
| JP | 2005-96188 | | 4/2005 |
| JP | 2005-238842 | | 9/2005 |
| JP | 2006-175765 | | 7/2006 |

OTHER PUBLICATIONS

Japanese Office Action issued on Jun. 8, 2011, in Japanese Patent Application No. 2006-350146 filed Dec. 26, 2006 (with English Translation).

* cited by examiner

*Primary Examiner* — Thinh Nguyen
(74) *Attorney, Agent, or Firm* — Oblon, Spivak, McClelland, Maier & Neustadt, L.L.P.

(57) ABSTRACT

A nozzle plate includes: a first silicon layer; a glass layer; a second silicon layer provided between the first silicon layer and the glass layer, the second silicon layer being bonded to the glass layer; and a silicon oxide layer provided between the first silicon layer and the second silicon layer. A nozzle hole passing through the first silicon layer and discharging a droplet is formed. A channel passing through the silicon oxide layer and the second silicon layer and communicating with the nozzle hole is formed. A liquid chamber formed in the glass layer and communicating with the channel is formed.

14 Claims, 16 Drawing Sheets

NOZZLE PLATE, METHOD FOR MANUFACTURING NOZZLE PLATE, DROPLET DISCHARGE HEAD, AND DROPLET DISCHARGE APPARATUS

CROSS-REFERENCE TO RELATED APPLICATIONS

This application is based upon and claims the benefit of priority from the prior Japanese Patent Application No. 2006-350146, filed on Dec. 26, 2006; the entire contents of which are incorporated herein by reference.

BACKGROUND OF THE INVENTION

1. Field of the Invention

This invention relates to a nozzle plate, a method for manufacturing a nozzle plate, a droplet discharge head, and a droplet discharge apparatus.

2. Background Art

Printing apparatuses such as printers and film forming (printing) apparatuses used for manufacturing flat panel displays and semiconductor devices are based on coloring and film forming techniques where ink or film material is discharged and flown toward an object by inkjet technology.

The droplet discharge head used in the inkjet technology is typically called "inkjet head" and composed of precision components manufactured by making full use of sophisticated techniques. In particular, the nozzle plate having nozzle holes from which ink or film material is discharged greatly affects basic operating characteristics such as impact and flight characteristics, and hence requires extremely high machining accuracy.

JP-A 9-216368(Kokai) (1997) discloses a nozzle plate that can be formed with high machining accuracy using an SOI (silicon on insulator) wafer. This nozzle plate is based on an SOI wafer on which a support layer of silicon, a dielectric layer of silicon oxide, and an active layer of silicon are laminated in this order. The nozzle plate is manufactured by dry etching the active layer to form nozzle holes therethrough, and etching the support layer and the dielectric layer to form taper portions communicating with the nozzle holes.

SUMMARY OF THE INVENTION

According to an aspect of the invention, there is provided a nozzle plate including: a first silicon layer; a glass layer; a second silicon layer provided between the first silicon layer and the glass layer, the second silicon layer being bonded to the glass layer; and a silicon oxide layer provided between the first silicon layer and the second silicon layer, a nozzle hole passing through the first silicon layer and discharging a droplet being formed, a channel passing through the silicon oxide layer and the second silicon layer and communicating with the nozzle hole being formed, and a liquid chamber formed in the glass layer and communicating with the channel being formed.

According to another aspect of the invention, there is provided a nozzle plate including; a silicon layer; and a glass layer bonded to the silicon layer, a nozzle hole passing through the silicon layer and discharging a droplet being formed, a liquid chamber communicating with the nozzle hole being formed in the glass layer, and a cover film being formed on an inner wall of the nozzle hole, the cover film being made of a material having a higher affinity for liquid discharged from the nozzle hole than silicon.

According to another aspect of the invention, there is provided a method for manufacturing a nozzle plate, including: in a laminated body including a first silicon layer, a second silicon layer, and a silicon oxide layer provided between the first silicon layer and the second silicon layer, forming a nozzle hole passing through the first silicon layer; forming a channel passing through the second silicon layer; removing the silicon oxide layer exposed to bottom of the channel so that the nozzle hole communicates with the channel; and anodic bonding the second silicon layer to a glass layer having a liquid chamber so that the channel communicates with the liquid chamber.

According to another aspect of the invention, there is provided a droplet discharge head including: a nozzle plate; and pressurizing means for applying pressure to liquid in the liquid chamber, the nozzle plate including: a first silicon layer; a glass layer; a second silicon layer provided between the first silicon layer and the glass layer, the second silicon layer being bonded to the glass layer; and a silicon oxide layer provided between the first silicon layer and the second silicon layer, a nozzle hole passing through the first silicon layer and discharging a droplet being formed, a channel passing through the silicon oxide layer and the second silicon layer and communicating with the nozzle hole being formed, and a liquid chamber formed in the glass layer and communicating with the channel being formed.

According to another aspect of the invention, there is provided a droplet discharge head including: a nozzle plate; and pressurizing means for applying pressure to liquid in the liquid chamber, the nozzle plate including: a silicon layer; and a glass layer bonded to the silicon layer, a nozzle hole passing through the silicon layer and discharging a droplet being formed, a liquid chamber communicating with the nozzle hole being formed in the glass layer, and a cover film being formed on an inner wall of the nozzle hole, the cover film being made of a material having a higher affinity for liquid discharged from the nozzle hole than silicon.

According to another aspect of the invention, there is provided a droplet discharge apparatus including: a droplet discharge head; a driver for relatively moving an object and the droplet discharge head; and a controller for controlling the droplet discharge head and the driver, the droplet discharge head including; a nozzle plate; and pressurizing means for applying pressure to liquid in the liquid chamber, the nozzle plate including: a first silicon layer; a glass layer; a second silicon layer provided between the first silicon layer and the glass layer, the second silicon layer being bonded to the glass layer; and a silicon oxide layer provided between the first silicon layer and the second silicon layer, a nozzle hole passing through the first silicon layer and discharging a droplet being formed, a channel passing through the silicon oxide layer and the second silicon layer and communicating with the nozzle hole being formed, and a liquid chamber formed in the glass layer and communicating with the channel being formed.

According to another aspect of the invention, there is provided a droplet discharge apparatus including: a droplet discharge head; a driver for relatively moving an object and the droplet discharge head; and a controller for controlling the droplet discharge head and the driver, the droplet discharge head including: a nozzle plate; and pressurizing means for applying pressure to liquid in the liquid chamber, the nozzle plate including: a silicon layer; and a glass layer bonded to the silicon layer, a nozzle hole passing through the silicon layer and discharging a droplet being formed, a liquid chamber communicating with the nozzle hole being formed in the glass layer, and a cover film being formed on an inner wall of the nozzle hole, the cover film being made of a material having a higher affinity for liquid discharged from the nozzle hole than silicon.

DETAILED DESCRIPTION OF THE INVENTION

Embodiments of the invention will now be described with reference to the drawings.

Figure 1:
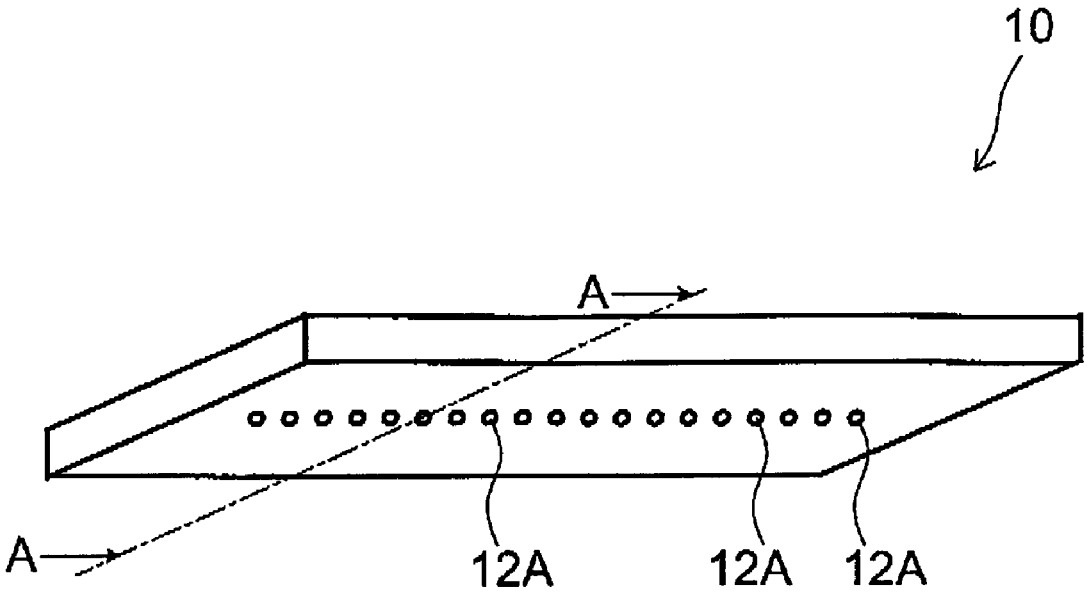
FIG. 1 is a schematic external view of a nozzle plate according to a first embodiment of the invention as viewed from its nozzle hole side.

FIG. 1 is a schematic external view of a nozzle plate according to a first embodiment of the invention as viewed from its nozzle hole side.

Figure 2:
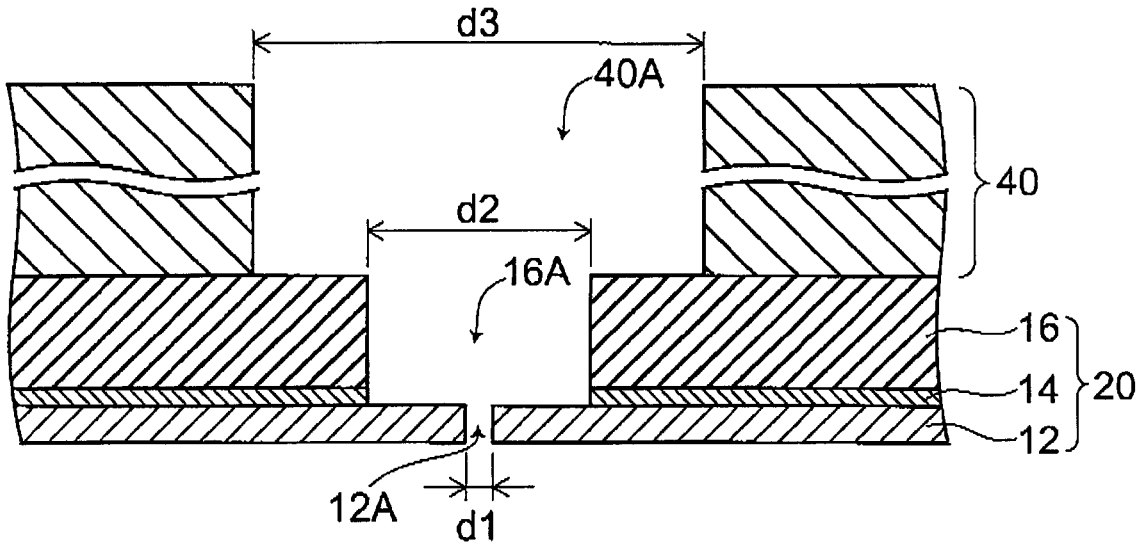
FIG. 2 is a cross-sectional view taken along A-A of FIG. 1.

FIG. 2 is a cross-sectional view taken along A-A of FIG. 1.

On the droplet discharge side, the nozzle plate 10 has a plurality of nozzle holes 12A aligned at a prescribed pitch and can discharge a liquid such as ink or film forming material. As shown in FIG. 2, the nozzle plate 10 has a structure in which an SOI layer 20 and a glass layer 40 are laminated. The SOI layer 20 has a structure in which a first silicon layer 12, a silicon oxide layer 14, and a second silicon layer 16 are laminated in this order. The first silicon layer 12 has a nozzle hole 12A for discharging liquid toward an object. On the other hand, the silicon oxide layer 14 and the second silicon layer 16 have a channel 16A communicating with the nozzle hole 12A. The opening shape of both the nozzle hole 12A and the channel 16A can be generally circular, for example.

The glass layer 40 has a liquid chamber 40A communicating with the channel 16A. The opening shape of the liquid chamber 40A may be generally circular, or various other shapes can also be used.

An example thickness of the layers is approximately as follows: 10 to 50 micrometers for the first silicon layer 12, 0.1 to 1 micrometer for the silicon oxide layer 14, 100 to 200 micrometers for the second silicon layer 16, and 0.8 to 2 millimeters for the glass layer 40.

In an example case where the opening diameter d1 of the nozzle hole 12A is 20 micrometers, the opening diameter d2 of the channel 16A can be 200 micrometers, and the opening diameter d3 of the liquid chamber can be 400 micrometers, approximately. According to the result of prototyping by the inventor, it was found preferable that the maximum of the opening diameter d2 at the widest portion of the channel 16A does not exceed 10 times the opening diameter d1 of the nozzle hole 12A in order to stabilize the discharge amount and discharge direction of discharged liquid. This is presumably because, if the opening diameter d2 of the channel 16A and the opening diameter d1 of the nozzle hole 12A are extremely different from each other, the cross-sectional area of the liquid channel is sharply narrowed toward the nozzle hole 12A, destabilizing the supply of liquid to the nozzle hole 12A.

According to this embodiment, use of the SOI layer 20 allows the nozzle hole 12A and the channel 16A to be formed with high accuracy in size, shape, and position. That is, as described later in detail, the nozzle hole 12A and the channel 16A can be formed with high accuracy by microfabrication techniques such as lithography and dry etching used in manufacturing semiconductor devices. Consequently, this embodiment can provide a nozzle plate 10 superior in operating characteristics such as impact and flight characteristics.

According to this embodiment, the glass layer 40 is laminated on such an SOI layer 20, and ink or other liquid is supplied from the liquid chamber 40A formed in the glass layer 40. This serves to improve the mechanical strength of the nozzle plate 10 along with reducing crosstalk, thereby achieving stable impact and flight characteristics. More specifically, while the thickness of the SOI layer 20 is made as thin as e.g. approximately 200 micrometers to facilitate machining, the mechanical strength can be sufficiently increased by bonding the glass layer 40. Furthermore, adjacent nozzle holes 12A are partitioned with the glass layer 40, which alleviates the effect of the liquid flow occurring when the liquid is discharged through the respective nozzle holes 12A. Thus the effect on the surrounding nozzle holes 12A is reduced.

In this case, it may be also considered to thicken the original SOI layer 20 instead of bonding a glass layer 40 thereto. For example, if the second silicon layer 16 has a thickness of 1 millimeter or more, the mechanical strength can be ensured, and the liquid chamber can be formed to suppress crosstalk. However, it is not easy to form liquid chambers and channels by machining a silicon layer having a thickness of 1 millimeter or more, and mass production is difficult. In contrast, by bonding a glass layer 40, this embodiment can provide an easily mass-produced, high-performance nozzle plate.

Furthermore, according to this embodiment, the SOI layer 20 and the glass layer 40 can be bonded together by anodic bonding to exclude the effect of impurities due to use of adhesives. This point is described later in detail.

Next, a method for manufacturing a nozzle plate of this embodiment is described.

FIGS. 3A through 3E are process cross-sectional views illustrating the method for manufacturing a nozzle plate of this embodiment. In FIGS. 3A through 3E and the following figures, the same elements as those shown in the previous figures are marked with like reference numerals, and the detailed description thereof is omitted accordingly.

The surface of an SOI wafer, on which a first silicon layer 12, a silicon oxide layer 14, and a second silicon layer 16 are laminated, is first etched to remove the oxide film on the surface. The SOI wafer used herein can be such that the major surface of the first silicon layer 12 and the second silicon layer 16 has a crystal orientation in the (100) plane, for example. However, the first silicon layer 12 and the second silicon layer 16 in this embodiment does not necessarily need to be a single crystal, but may be a polycrystal formed by CVD (chemical vapor deposition), for example.

Figure 3A:
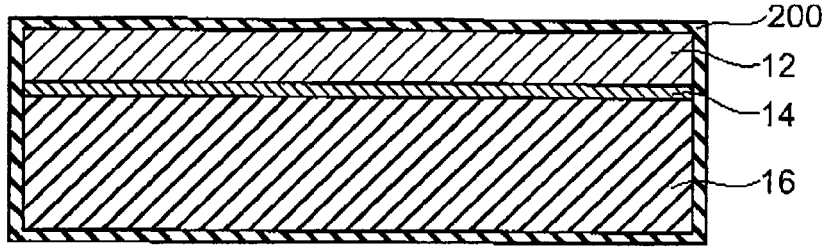
FIGS. 3A through 3E are process cross-sectional views illustrating a method for manufacturing a nozzle plate of this embodiment.

Such an SOI wafer is heat treated in a steam-containing oxygen atmosphere at 1100 degrees Celsius for approximately 10 hours. Thus, as shown in FIG. 3A, an oxide film 200 having a thickness of approximately 2 micrometers can be formed on the surface of the SOI wafer.

Figure 3B:
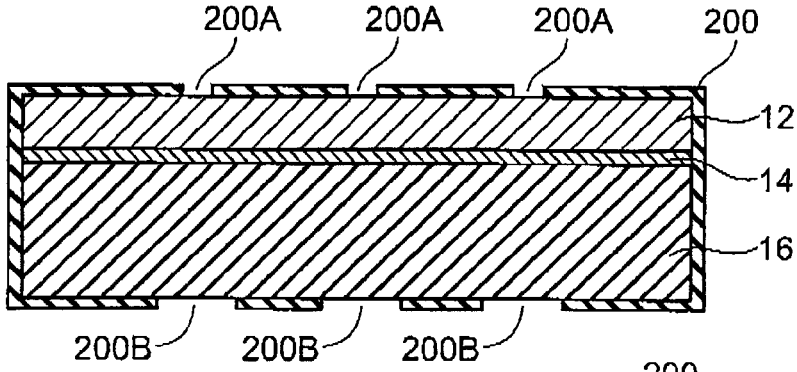

Next, as shown in FIG. 3B, the oxide film 200 is patterned by resist-based photolithography to form openings 200A and 200B.

Figure 3C:
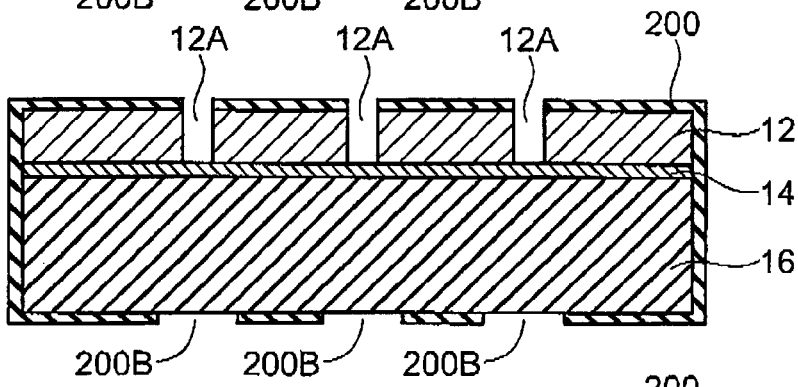

Next, as shown in FIG. 3C, the first silicon layer 12 exposed to the openings 200A is etched to form nozzle holes 12A. In this step, the openings 200A can be used as a mask to form generally vertical nozzle holes 12A illustratively by RIE (reactive ion etching) based on ICP (inductive coupled plasma) with fluorine-based or chlorine-based etching gas. Here, it is possible to etch only the first silicon layer 12 by using the silicon oxide layer 14 as an etching stopper. That is, when halogen-based etching gas is used, the etching rate for silicon oxide can be made sufficiently lower than the etching rate for silicon. Hence the silicon oxide layer 14 can be used as an etching stopper.

Figure 3D:
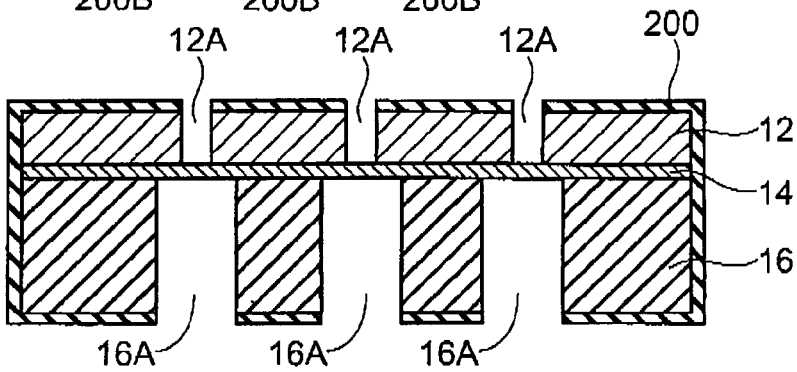

Next, as shown in FIG. 3D, the second silicon layer 16 exposed to the openings 200B is etched to form channels 16A. In this step, by using ICP and RIE as described above, the openings 200B can be used as a mask to etch the second silicon layer 16 generally vertically.

Figure 3E:
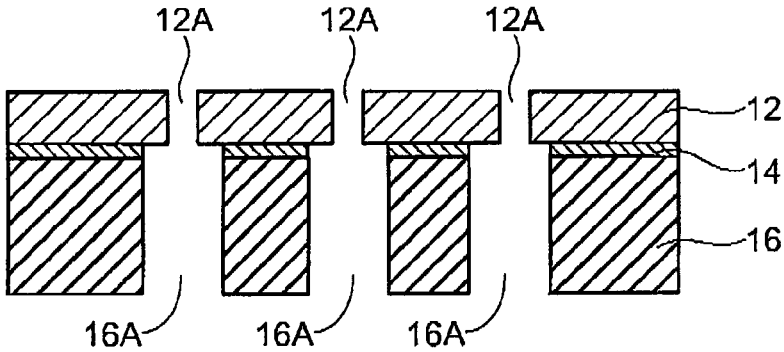

Next, as shown in FIG. 3E, the silicon oxide layer 14 exposed to the bottom of the channels 16A and the oxide film 200 covering the surface of the SOI wafer are removed. This step can be performed by wet etching with fluorine-based etchant, for example. Thus the channel 16A communicates with the nozzle hole 12A Then the SOI wafer is diced to cut out the SOI layer 20 to be installed in a nozzle plate.

The nozzle holes 12A and the channels 16A of the SOI layer 20 thus obtained can be stably formed with an accuracy of e.g. ±1 micrometer or less in size and position. This allows a nozzle plate with high accuracy to be manufactured reliably and easily.

Then, separately, a glass layer 40 with liquid chambers 40A formed therein is bonded to the SOI layer 20 by anodic bonding. Thus the nozzle plate 10 shown in FIGS. 1 and 2 is completed.

Here, anodic bonding is a method for tight bonding between a glass containing movable ions and a silicon by stacking them and applying heat and voltage thereto. A glass and a silicon are stacked and heated to approximately 300 to 400 degrees Celsius A voltage of approximately several hundred volts, for example, is applied thereto with the glass side acting as a cathode and the silicon side acting as an anode. The atmosphere used may be either ambient air or nitrogen. Then an electric double layer is produced, and positive ions contained in the glass are forced to diffuse into the cathode side. Consequently, an electrostatic force is produced between the glass and the silicon and enhances close contact therebetween. Thus the glass and the silicon are bonded together by chemical reaction.

Because anodic bonding can be performed in the solid phase, the SOI layer 20 and the glass layer 40 can be bonded together with high positional accuracy. That is, misalignment between the SOI layer 20 and the glass layer 40 can be prevented. Furthermore, because anodic bonding is performed without adhesives, it is not affected by impurities. More specifically, as shown in FIG. 2, the bonding face of the SOI layer 20 and the glass layer 40 is exposed to the liquid chamber 40A and the channel 16A. Hence, if the SOI layer 20 and the glass layer 40 are bonded together with an adhesive, ink or other liquid stored in the chamber 40A and the channel 16A is in contact with the adhesive. In this case, ingredients contained in the adhesive may dissolve into and deteriorate the ink or other liquid, or conversely, ingredients contained the ink or other liquid may deteriorate the adhesive.

In contrast, by using anodic bonding, no impurities are present at the bonding interface between the SOI layer 20 and the glass layer 40, and there is no danger of deteriorating the ink or other liquid and causing deterioration at the bonding interface. Consequently, it is possible to provide a nozzle plate that can stably operate over a long period of time for various discharge liquids.

It is noted that the glass layer 40 used in anodic bonding does not need to contain movable ions throughout its entirety. For example, when a glass layer containing no movable ions such as quartz is used, elements serving as movable ions can be introduced into the vicinity of the bonding interface by diffusion. Alternatively, a glass layer containing movable ions can be formed on the surface of the quartz by painting or coating. By these methods, a glass layer 40 containing no movable ions can be anodic bonded to the SOI layer 20.

In the following, additional features of the nozzle plate of this embodiment are described.

Figure 4A:
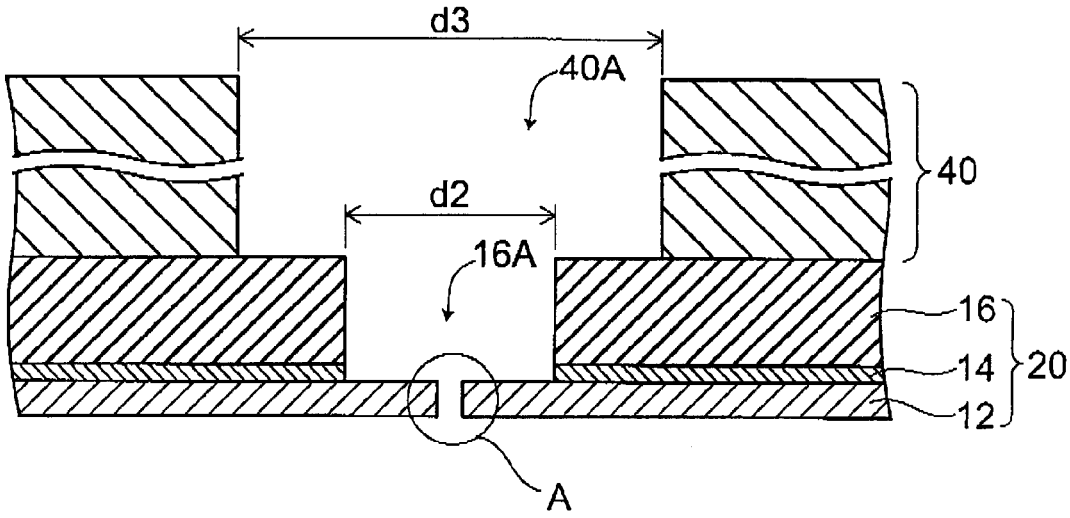
FIGS. 4A through 4D are schematic views for illustrating the opening shape of the nozzle hole 12A.

FIGS. 4A through 4D are schematic views for illustrating the opening shape of the nozzle hole 12A. More specifically, FIG. 4A shows the same cross-sectional structure as in FIG. 2, and FIGS. 4B to 4D are enlarged views of the portion indicated by label A in FIG. 4A.

Figures 4B, 4C, 4D:
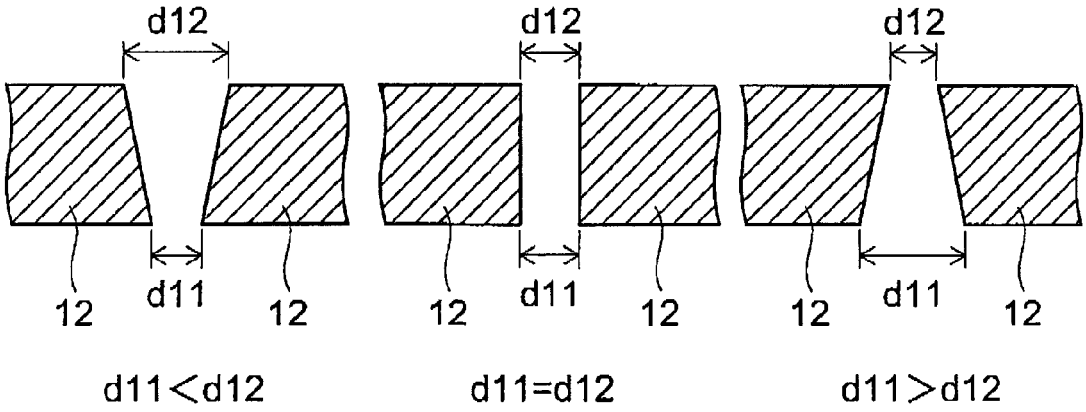

If the outlet-side opening diameter d11 and the inlet-side opening diameter d12 of the nozzle hole 12A are related by d11<d12 as shown in FIG. 4B or by d11=d12 as shown in FIG. 4C, then the liquid discharged from the nozzle hole 12A has generally good impact and flight characteristics. On the contrary, if d11>d12 as shown in FIG. 4D, the liquid discharged from the nozzle hole 12A tends to scatter around, decreasing impact and flight characteristics. Hence, preferably, the outlet-side opening diameter d11 of the nozzle hole 12A is comparable to or less than the inlet-side opening diameter d12.

Such an opening shape can be realized by, for example, using a somewhat depositive etching condition in the process described above with reference to FIG. 3C. More specifically, in a dry etching process with an etching gas, deposition of etching products may also proceed simultaneously with etching of the workpiece to be etched. In this case, the deposition of products may be more prominent on the sidewall of the opening formed by etching. That is, deposition proceeds more significantly on the upper portion of the sidewall of the opening formed by etching than on the lower portion. Consequently, widening of the opening diameter due to lateral etching may occur more significantly in the lower portion of the opening sidewall than in the upper portion. This property facilitates forming a nozzle hole 12A having an opening shape as shown in FIG. 4B.

Figure 5:
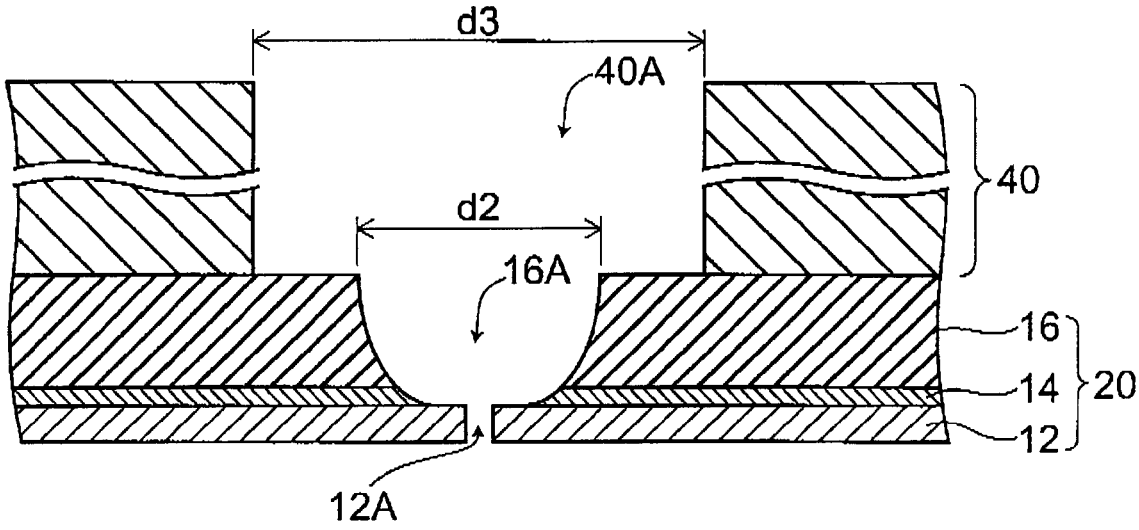
FIG. 5 is a schematic cross-sectional view showing a second example of this embodiment.

FIG. 5 is a schematic cross-sectional view showing a second example of this embodiment.

In this example, the opening shape is such that the channel 16A converges toward the nozzle hole 12A. With such an opening shape, the flow of ink or other liquid from the liquid chamber 40A toward the nozzle hole 12A can be made more smooth, and impact and flight characteristics can be further improved. Such a converging opening shape can be realized by, for example, in the process described above with reference to FIG. 3D, using wet etching with etching anisotropy relative to the silicon surface orientation. Alternatively, by dry etching with fluorine or other etching gas under the condition that etching proceeds isotropically, the second silicon layer 16 below the oxide film 200 around the opening 200B can be undercut to form a channel 16A having a converging shape as shown in FIG. 5.

Figure 6:
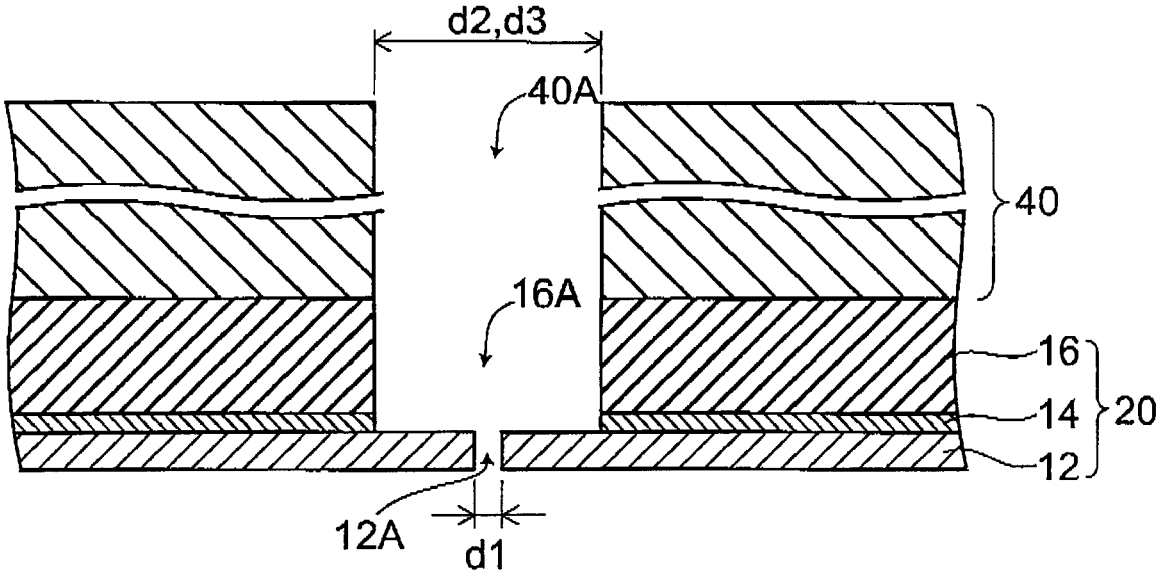
FIG. 6 is a schematic cross-sectional view showing a third example of this embodiment.

FIG. 6 is a schematic cross-sectional view showing a third example of this embodiment.

In this example, the opening diameter d2 of the channel 16A is nearly equal to the opening diameter d3 of the liquid chamber 40A. For example, in the case where the opening diameter d1 of the nozzle hole 12A is small, the portion of sharply narrowing the flow of liquid may be eliminated by substantially equalizing d2 and d3 in this manner, allowing the liquid to be smoothly supplied to the nozzle hole 12A. By way of example, when the opening diameter d1 of the nozzle hole 12A is 20 micrometers, both the opening diameter d2 of the channel 16A and the opening diameter d3 of the liquid chamber 40A can be approximately 200 micrometers.

Figure 7:
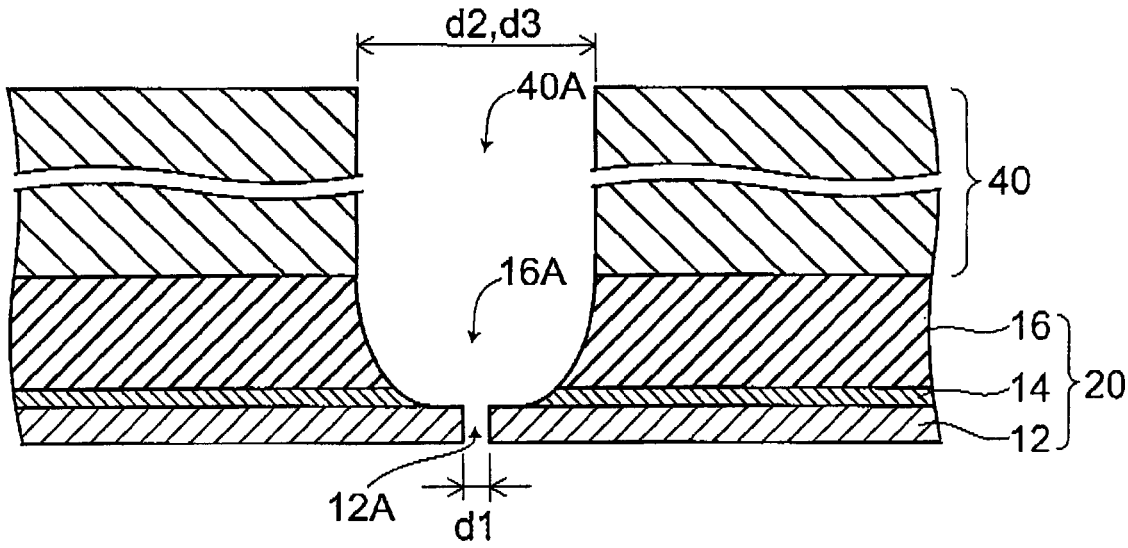
FIG. 7 is a schematic cross-sectional view showing a fourth example of this embodiment.

FIG. 7 is a schematic cross-sectional view showing a fourth example of this embodiment.

This example is a combination of the example shown in FIG. 5 and the example shown in FIG. 6. More specifically, the opening diameter d2 of the upper end of the channel 16A is substantially equalized to the opening diameter d3 of the liquid chamber 40A, and the channel 16A has an opening shape converging toward the nozzle hole 12A. Then the portion of sharply narrowing the flow of liquid is further decreased, allowing the liquid to be more smoothly supplied to the nozzle hole 12A.

Figure 8:
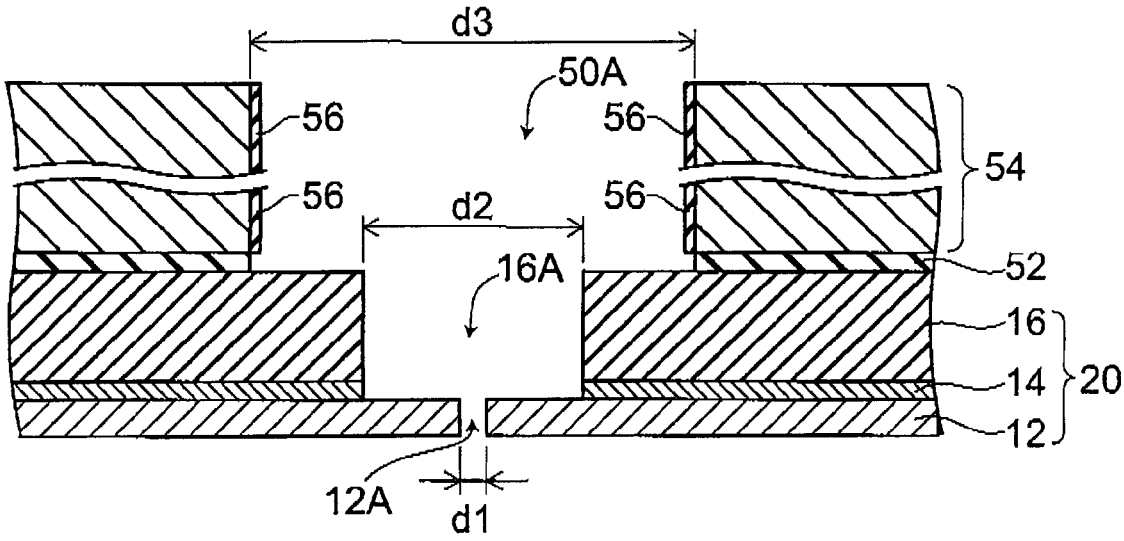
FIG. 8 is a schematic cross-sectional view showing a fifth example of this embodiment.

FIG. 8 is a schematic cross-sectional view showing a fifth example of this embodiment.

In this example, a thin glass layer 52 is provided on the SOI layer 20, and a liquid chamber layer 54 is provided on the glass layer 52. The liquid chamber layer 54 is formed from metal or inorganic material and includes a liquid chamber 50A. The structure of this example is obtained by forming a glass layer 52 on the surface of a liquid chamber layer 54 followed by anodic bonding between the glass layer 52 and the SOI layer 20. For example, a glass layer 52 containing movable ions is formed on the surface of the liquid chamber layer 54 by sputtering or painting, and the glass layer 52 can be anodic bonded to the SOI layer 20. In this case, the thickness of the glass layer 52 may be approximately several micrometers.

The liquid chamber layer 54 can be illustratively formed from stainless steel or metal such as platinum, tantalum, or nickel. Use of metal facilitates machining, and even a liquid chamber 50A having a complicated shape can be rapidly formed at low cost. When the liquid chamber layer 54 is made of metal, a cover layer 56 is preferably provided on the contact surface with the liquid to prevent corrosion by the ink or other liquid. The cover layer 56 may be a glass or other layer illustratively formed by painting or other methods. When the liquid chamber layer 54 is made of stainless steel, a cover layer 56 can be formed on its surface by passivation.

When the nozzle plate is used for manufacturing a liquid crystal display or a semiconductor device, a liquid containing corrosive materials such as hydrofluoric acid or other acids or alkalis may be often used as the discharged liquid. Even in this case, the corrosion of the liquid chamber layer 54 can be prevented by the cover layer 56.

According to this example, the liquid chamber layer 54 can be made of various materials other than glass. Hence this example has an effect of facilitating the machining of a liquid chamber 50A with a complicated shape and reducing the material cost.

Next, a second embodiment of the invention is described.

Figure 9:
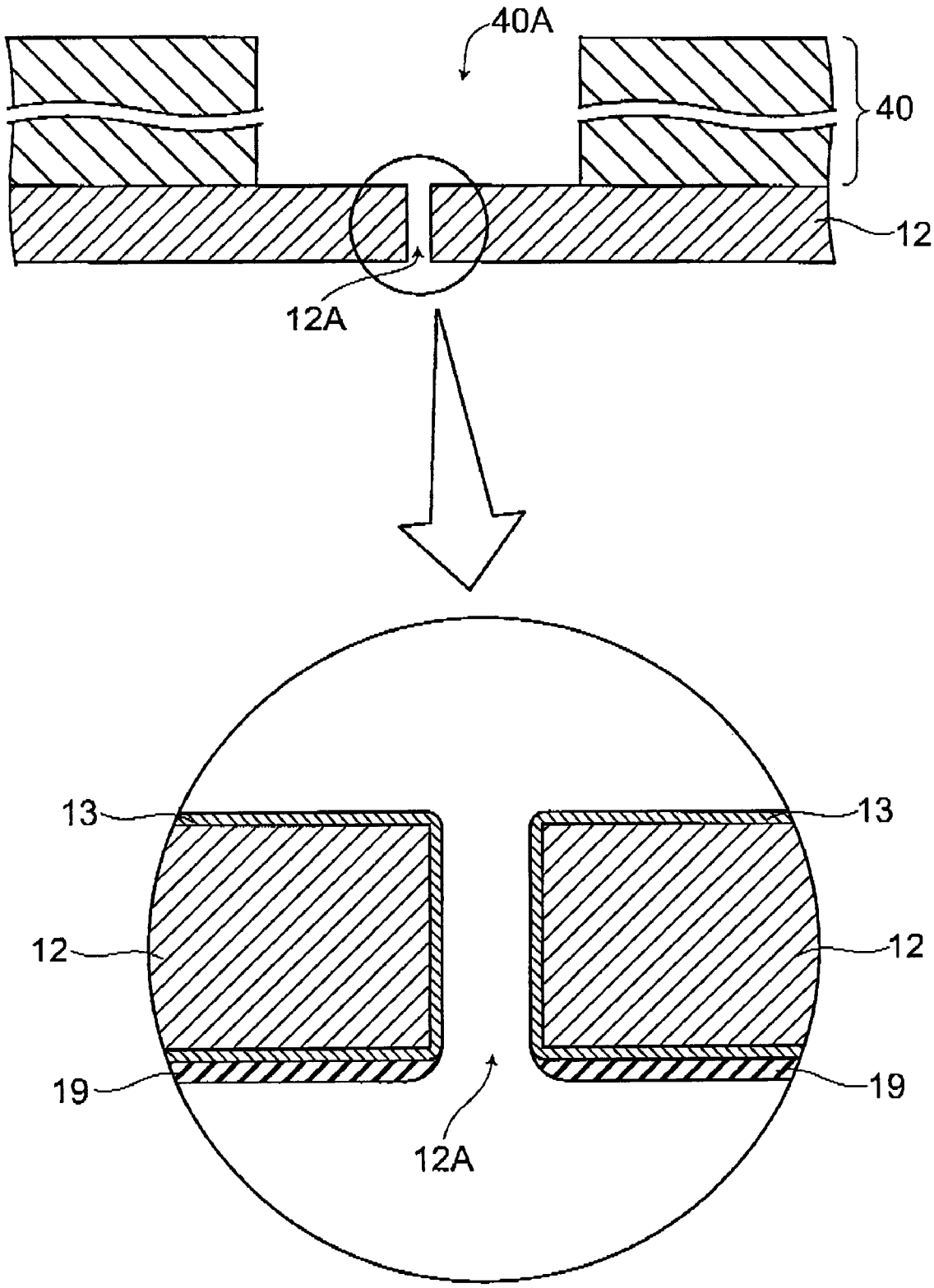
FIG. 9 is a schematic view showing the cross-sectional structure of a nozzle plate according to the second embodiment of the invention.

FIG. 9 is a schematic view showing the cross-sectional structure of a nozzle plate according to the second embodiment of the invention.

The nozzle plate of this embodiment includes a silicon layer 12 and a glass layer 40. The silicon layer 12 and the glass layer 40 are bonded together by anodic bonding. The silicon layer 12 has nozzle holes 12A, and the glass layer 40 has liquid chambers 40A. As shown in the enlarged view of the inset, a cover film 13 is formed on the inner wall of the nozzle hole 12A. Furthermore, a water-repellent layer 19 is formed on the discharge surface of the silicon layer 12.

The cover film 13 is formed from a material having a higher affinity for the liquid discharged from the nozzle hole 12A than silicon. For example, when the liquid discharged from the nozzle hole 12A is hydrophilic, it has low affinity for silicon. That is, silicon is hydrophobic and exhibits a water-repellent effect for hydrophilic liquid. However, if the inner wall of the nozzle hole 12A produces a water-repellent effect, passage of ink or other liquid therethrough is made difficult, and its smooth discharge is hampered. This tendency becomes more prominent as the opening diameter d1 of the nozzle hole 12A decreases.

In contrast, according to this embodiment, a cover film 13 having a higher affinity for the liquid than silicon is provided on the inner wall of the nozzle hole 12A to avoid the water-repellent effect on the inner wall of the nozzle hole 12A. Consequently, ink or other liquid can smoothly pass through the nozzle hole 12A, and smooth discharge can be ensured even in the case where the opening diameter of the nozzle hole 12A is decreased.

When the discharged liquid is hydrophilic, the cover film 13 can be illustratively made of silicon oxide. For example, the contact angle for pure water is 60 degrees or more on the silicon surface, but can be decreased to 10 degrees or less on the surface of silicon oxide.

The inventor prototyped a nozzle plate with a cover film 13, which is a thermal oxide film having a thickness of approximately 100 nanometers formed by thermal oxidation, and a nozzle plate without such a cover film 13, and performed discharge experiments, where the opening diameter of the nozzle hole 12A was 20 micrometers. As a result, for hydrophilic ink, the rate of nondischarging nozzles (nozzle holes 12A with insufficient discharge) was 35 percent in the nozzle plate without a cover film 13, whereas the rate of nondischarging nozzles was improved to 0 percent in the nozzle plate with the cover film 13 of silicon oxide.

Advantageously, the cover film 13 made of a thermal oxide film of silicon has high adhering strength to the matrix silicon layer 12 and can be easily formed as a dense film.

It is noted that the material and thickness of the cover film 13 in this embodiment can be suitably determined depending on the type of discharged liquid. That is, a cover film 13 made of a material having high affinity for the discharged liquid can be used to prevent the water-repellent effect on the inner wall of the nozzle hole 12A and to ensure smooth discharge. For example, when a liquid containing water-immiscible materials such as benzene-based, decane-based, or fluorine-based materials is discharged, it is preferable to form a cover film 13 made of a material having high affinity for these materials.

On the other hand, the water-repellent layer 19 used in this embodiment has an effect of preventing ink or other liquid from adhering to the discharge surface of the nozzle plate. When a water-soluble liquid is discharged, the water-repellent layer 19 can be illustratively made of a fluorine-based resin such as polytetrafluoroethylene (PTFE) or tetrafluoroethylene (TFE). Advantageously, these fluorine-based resins have high water repellency and are also superior in chemical resistance and heat resistance.

Figure 10:
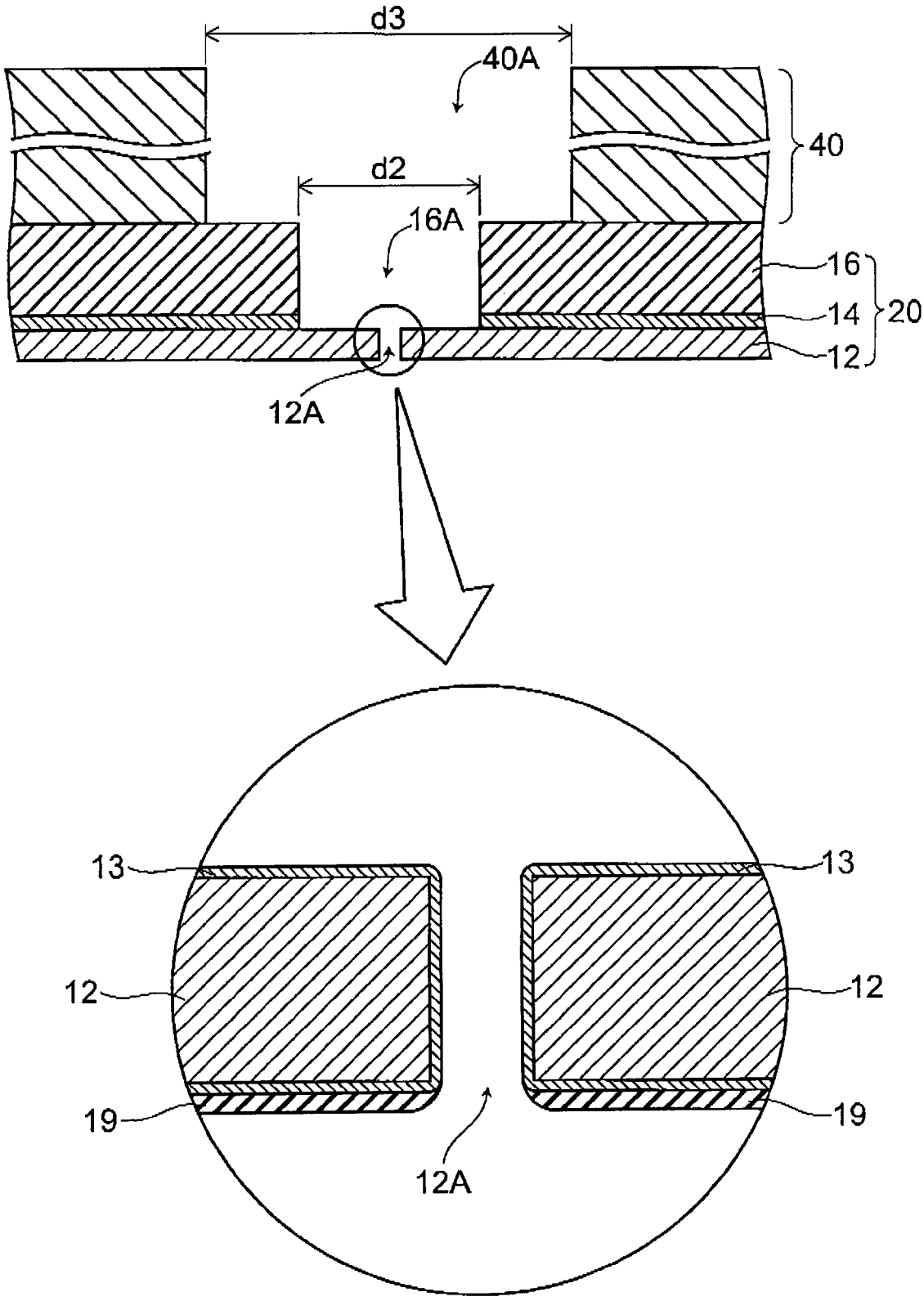
FIG. 10 is a schematic cross-sectional view showing a second example of this embodiment.

FIG. 10 is a schematic cross-sectional view showing a second example of this embodiment.

More specifically, in this example, the nozzle plate 10 described above with reference to FIG. 2 is provided with a cover film 13 and a water-repellent layer 19. This example achieves both the effect described above with reference to the first embodiment and the effect of this embodiment. Consequently, even in the case where the opening diameter of the nozzle hole 12A is decreased, it can be formed with accuracy in position and shape, and the liquid is smoothly discharged. Thus it is possible to provide a nozzle plate superior in operating characteristics such as impact and flight characteristics.

Figure 11:
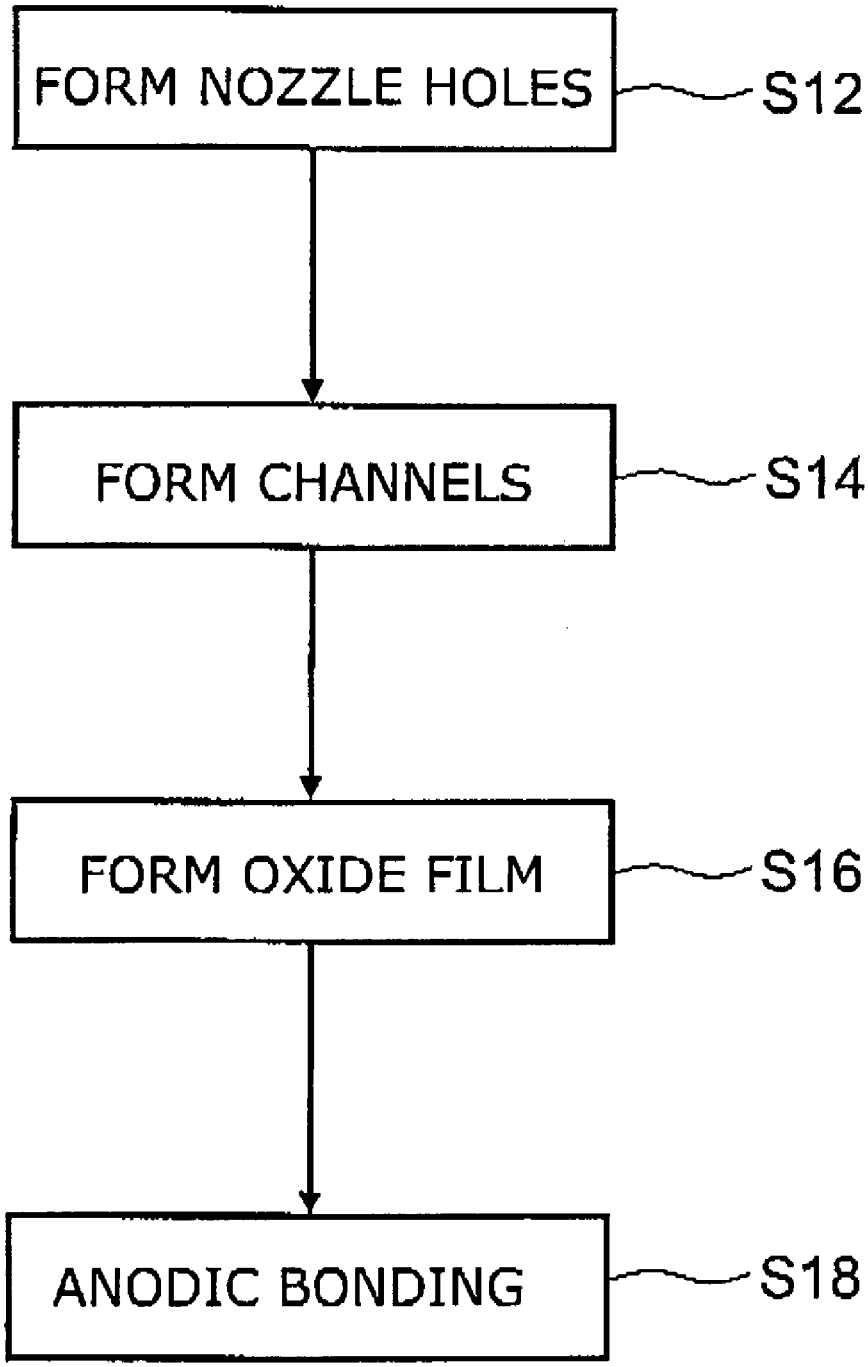
FIG. 11 is a flow chart illustrating a method for manufacturing a nozzle plate shown in FIG. 10.

FIG. 11 is a flow chart illustrating a method for manufacturing a nozzle plate shown in FIG. 10. First, nozzle holes 12A are formed (step S12). This is as described above with reference to FIGS. 3A to 3C. Then channels 16A are formed (step S14). This is as described above with reference to FIGS. 3D and 3E.

Subsequently, a silicon oxide film is formed as the cover film 13 (step S16). The silicon oxide film can be formed illustratively by thermal oxidation, by contact with oxidizing liquid, or by deposition using sputtering or CVD (chemical vapor deposition). Then the SOI layer 20 is anodic bonded to the glass layer 40 (step S18).

In this example, a silicon oxide film serving as the cover film 13 is formed before anodic bonding. Hence a high-temperature process is also applicable. More specifically, the temperature during anodic bonding is approximately 400 degrees Celsius. If the temperature is further increased after bonding, delamination and breakage may occur due to the difference of thermal expansion coefficient between the SOI layer 20 and the glass layer 40. In contrast, according to this example, the silicon oxide film is formed before anodic bonding. Hence a high-temperature process such as thermal oxidation can be performed.

Figure 12:
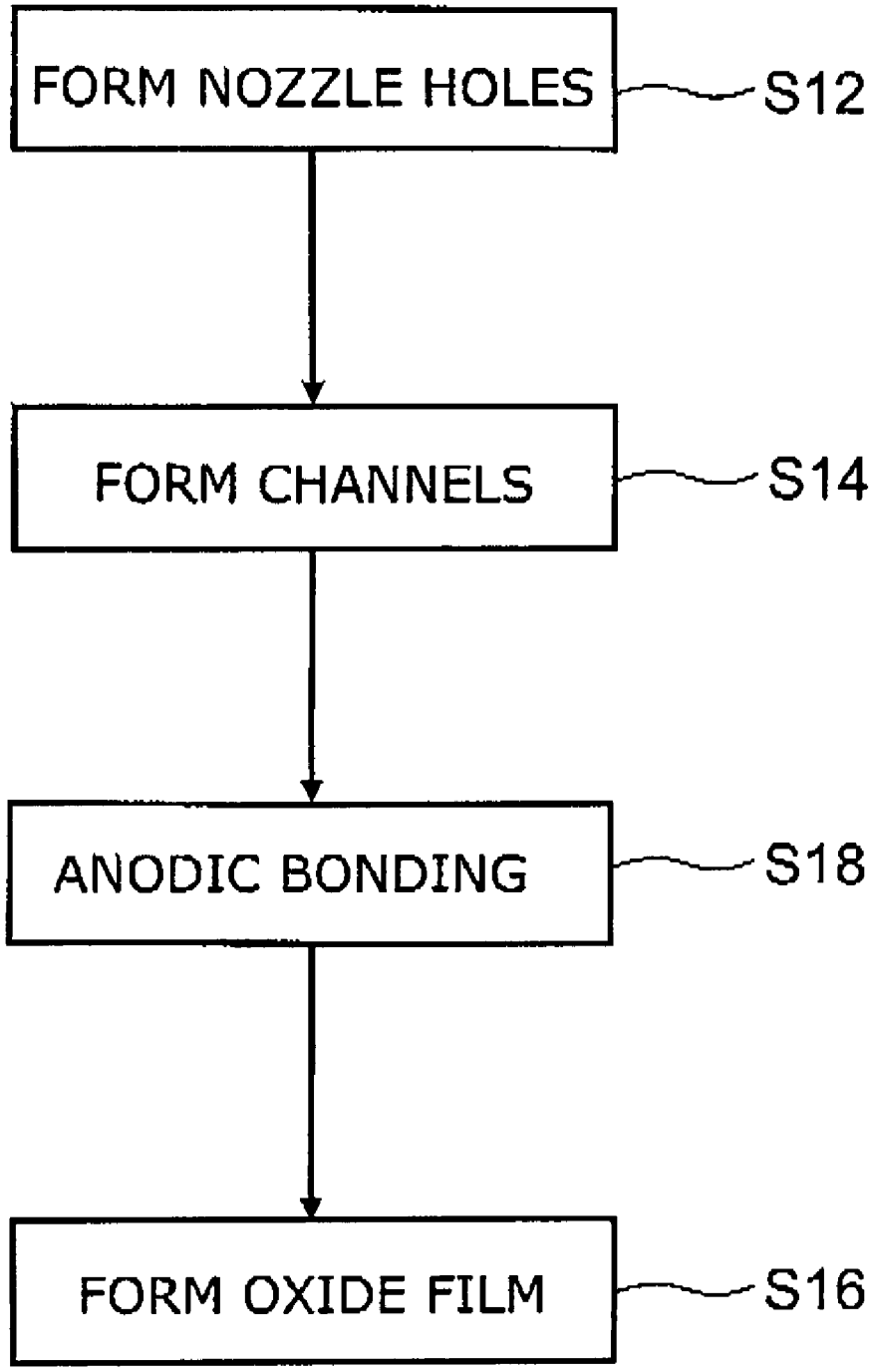
FIG. 12 is a flow chart illustrating another example method for manufacturing a nozzle plate shown in FIG. 10.

FIG. 12 is a flow chart illustrating another example method for manufacturing a nozzle plate shown in FIG. 10.

Also in this example, first, nozzle holes 12A are formed (step S12), and channels 16A are formed (step S14).

Subsequently, anodic bonding is performed (step S18). Then a silicon oxide film is formed as the cover film 13 (step S16). In this case, high-temperature heating cannot be used in the process of forming the silicon oxide film. However, methods other than thermal oxidation can be used to form a silicon oxide film.

For example, a silicon oxide film having a thickness of 1 nanometer or more can be formed on the silicon surface by bringing silicon into contact with a mixture liquid of sulfuric acid or other acid and hydrogen peroxide solution. Likewise, a silicon oxide film having a thickness of 1 nanometer or more can be formed on the silicon surface also by bringing silicon into contact with any one of ozone water, a mixed liquid of acid and ozone water, and hydrogen peroxide solution. Sputtering or CVD can be also used.

In any of these methods, a silicon oxide film can be formed at a temperature lower than in anodic bonding. Hence a silicon oxide film serving as the cover film 13 can be formed after anodic bonding with the glass layer 40.

Next, a third embodiment of the invention is described with reference to an example of a glass layer 40, a droplet discharge head, and a droplet discharge apparatus.

Figure 13A:
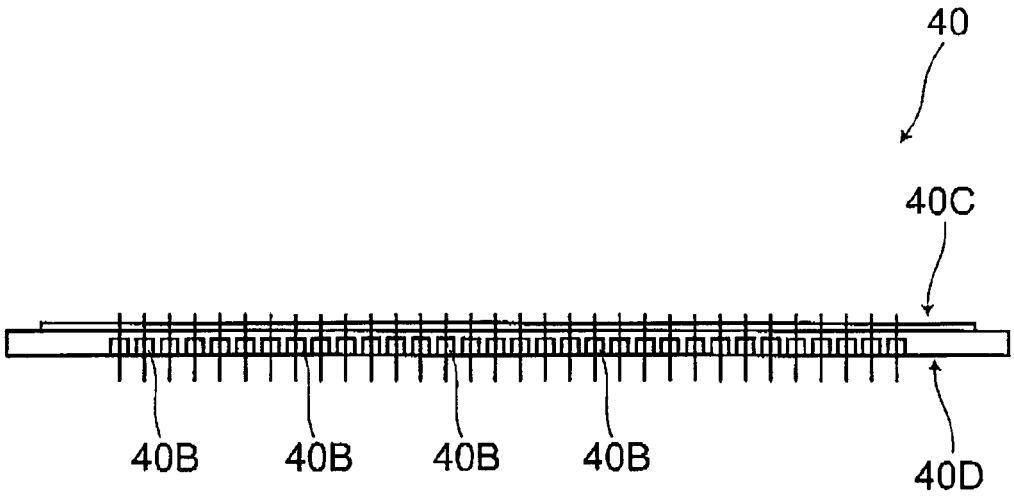
FIGS. 13A and 13B are schematic views showing an example of the glass layer 40.
Figure 13B:
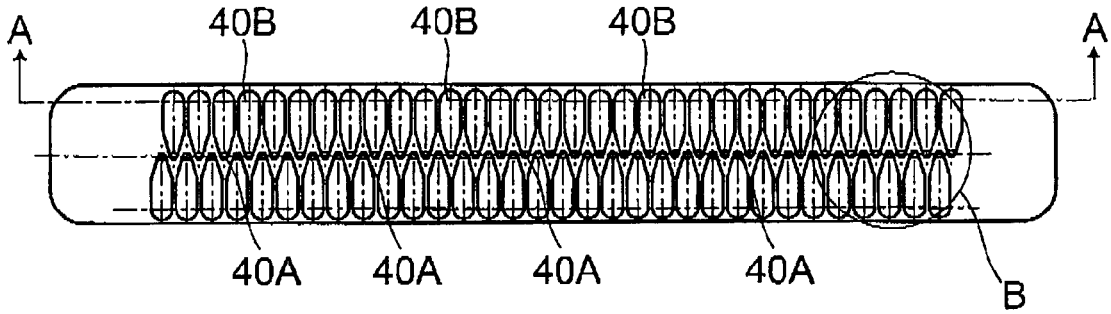

FIGS. 13A and 13B are schematic views showing an example of the glass layer 40. More specifically, FIG. 13A is a cross-sectional view of the glass layer 40, and FIG. 13B is a plan view of the glass layer 40. Here, FIG. 13A is a cross-sectional view taken along line A-A of FIG. 13B, and FIG. 13B is a schematic view as observed from a major surface 40D on the opposite side of the bonding surface 40C to be bonded to the SOI layer 20.

At the center of the glass layer 40, liquid chambers 40A are formed along the length at a fixed spacing. A liquid feed path 40B is formed in continuation from each of the liquid chambers 40A along the width of the glass layer 40.

Figure 14A:
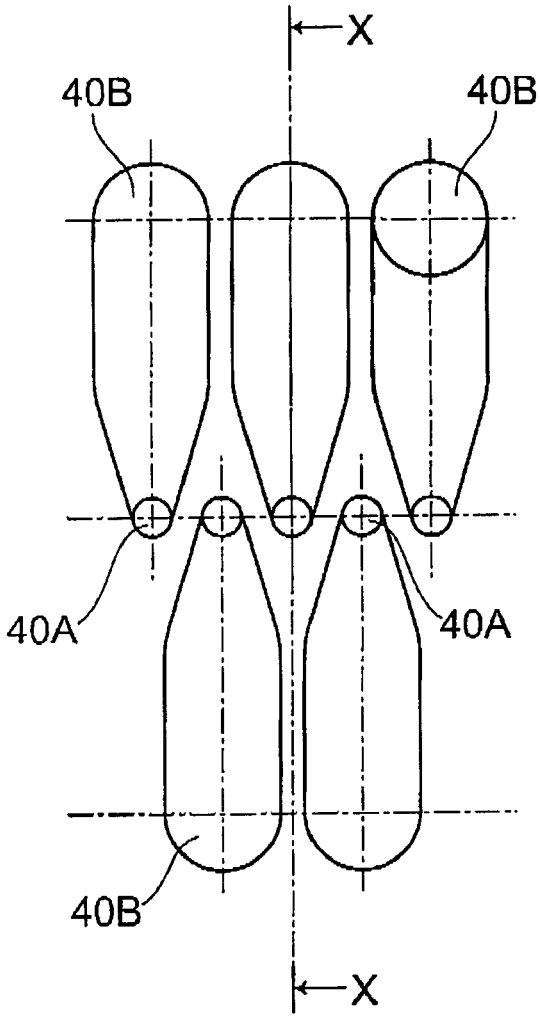
FIG. 14A is an enlarged view of the portion of label B in FIG. 13B.
Figure 14B:
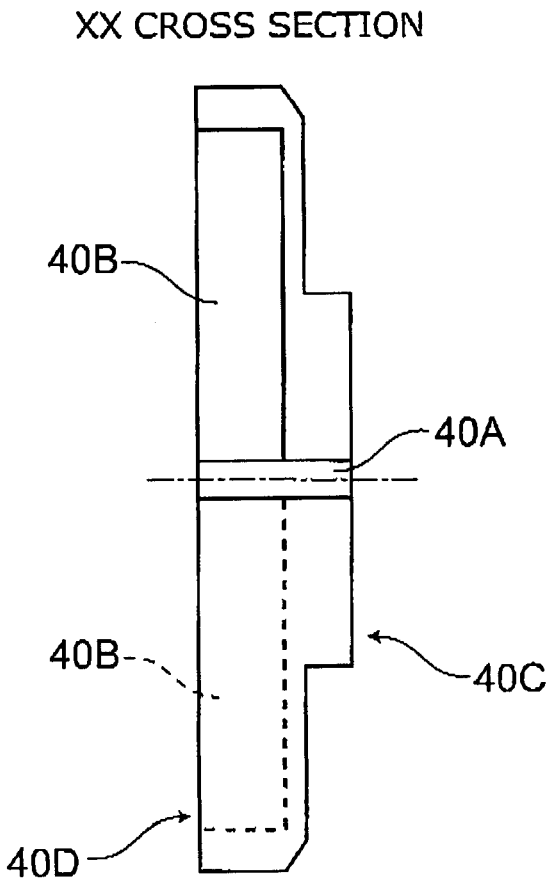
FIG. 14B is a cross-sectional view taken along line X-X of FIG. 14A.

FIG. 14A is an enlarged view of the portion of label B in FIG. 13B. FIG. 14B is a cross-sectional view taken along line X-X of FIG. 14A.

The liquid chamber 40A opening to the bonding surface 40C of the glass layer 40 communicates with the feed path 40B provided on the major surface 40D side opposite to the bonding surface 40C and is supplied with ink or other liquid from the feed path 40B.

Figure 15:
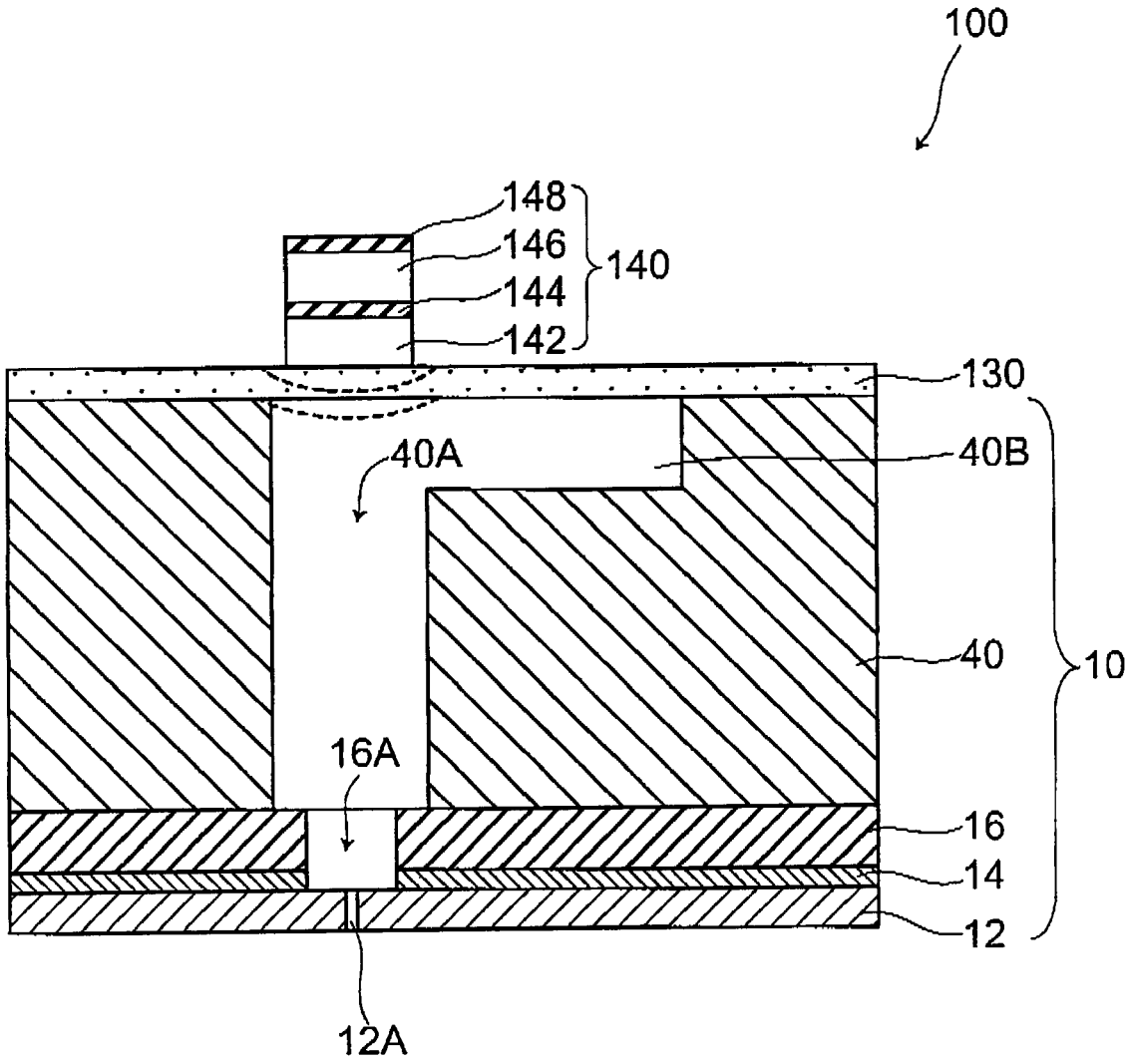
FIG. 15 is a schematic cross-sectional view illustrating the structure of a droplet discharge head according to this embodiment.

FIG. 15 is a schematic cross-sectional view illustrating the structure of a droplet discharge head according to this embodiment.

More specifically, driving mechanisms for a droplet discharge head include the "thermal type", where bubbles are produced by heating and the film boiling phenomenon is used to discharge liquid, and the "piezoelectric type", where the bending displacement of a piezoelectric element is used to discharge liquid. Here, for convenience of description, this embodiment is illustrated with reference to the piezoelectric type.

As shown in FIG. 14, the droplet discharge head 100 comprises a flexible film 130 provided on the nozzle plate 10 and a piezoelectric element 140 provided on the flexible film 130. In the case of the "piezoelectric type", the flexible film 130 and the piezoelectric element 140 serve as a pressurizing means for applying pressure to the liquid in the liquid chamber 40A. The piezoelectric element 140 is formed by, for example, laminating a lower member 142, a driving electrode 144, an upper member 146, and a driving electrode 148 in this order followed by integral burning. Such a piezoelectric element 140 formed by integral burning has high strength and can be easily handled.

A feed path 40B is provided so as to open to the surface (upper surface) of the glass layer 40, and the flexible film 130 is provided so as to cover the opening of the feed path 40B. The liquid chamber 40A communicates with the feed path 40B on the opposite side of the opening of the feed path 40B.

Preferably, the piezoelectric element 140 is provided directly above the liquid chamber 40A so that the pressure wave due to the bending displacement of the piezoelectric element 140 is easily transmitted from the liquid chamber 40A to the liquid in the channel 16A and the nozzle hole 12A.

The flexible film 130 can be made of polyethylene terephthalate. The lower member 142 and the upper member 146 of the piezoelectric element 140 can be made of piezoelectric ceramic (e.g., lead zirconate titanate), and the driving electrode 144 and the driving electrode 148 can be made of a copper alloy. However, these materials are not limited to the above examples, but can be variously modified.

Furthermore, the arrangement and shape of each component are not limited to those illustrated in FIG. 15, but can be variously modified. For example, each liquid chamber 40A does not need to communicate with its dedicated feed path 40B, but a plurality of liquid chambers 40A may communicate with a common feed path 40B. In terms of the structure of the piezoelectric element 140, the lower member 142 is a vibrating plate, and the upper member 146 is a piezoelectric body. However, the invention is not limited thereto. Various driving mechanisms can be used for causing displacement.

Figure 16:
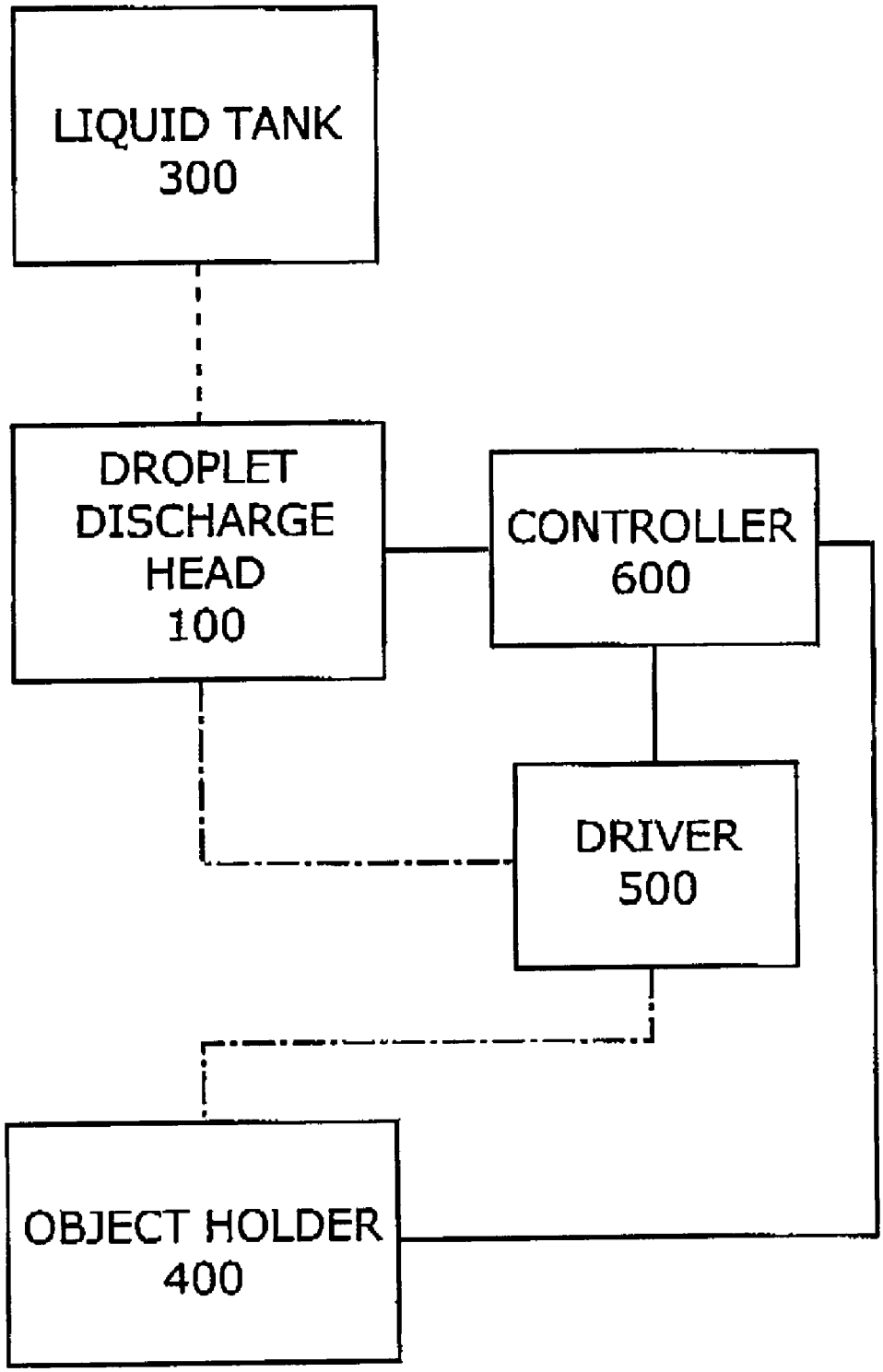
FIG. 16 is a block diagram illustrating a droplet discharge apparatus according to this embodiment.

FIG. 16 is a block diagram illustrating a droplet discharge apparatus according to this embodiment.

This droplet discharge apparatus comprises a liquid tank 300 for storing ink or other liquid to be discharged, a droplet discharge head 100 for discharging a droplet, an object holder 400 for holding an object that receives the discharged droplet, a driver 500 for relatively moving the droplet discharge head 100 and the object holder 400, and a controller 600 for controlling the droplet discharge head 100, the object holder 400, and the driver 500.

According to this embodiment, it is possible to print on a sheet of paper held in the object holder 400, to form a resist or color filter pattern on a glass substrate constituting a flat panel display such as a liquid crystal display, and to form a resist or insulating layer pattern on a semiconductor wafer.

The nozzle plate of this embodiment formed with high accuracy and being less susceptible to crosstalk can be used to print or form a fine pattern with high accuracy and reproducibility.

The embodiments of the invention have been described with reference to the examples. However, the invention is not limited to these examples. That is, the above examples can be suitably modified by those skilled in the art, and such modifications are also encompassed within the scope of the invention as long as they include the features of the invention.

For example, the invention is applicable not only to a droplet discharge head of the multi-nozzle type, but also to a droplet discharge head having a single nozzle hole. Furthermore, the shape, dimension, material, and arrangement of the illustrated components such as the nozzle plate, the droplet discharge head, and the droplet discharge apparatus are not limited to the above examples, but can be suitably modified.

The components constituting the above examples can be combined as long as feasible, and such combinations are also encompassed within the scope of the invention as long as they include the features of the invention.

The method for manufacturing a nozzle plate is not limited to the above example, but can be suitably modified.

The invention claimed is:

1. A nozzle plate comprising:
a first silicon layer;
a glass layer;
a second silicon layer provided between the first silicon layer and the glass layer, the second silicon layer being bonded to the glass layer; and
a silicon oxide layer provided between the first silicon layer and the second silicon layer,
a nozzle hole passing through the first silicon layer and discharging a droplet being formed,
a channel passing through the silicon oxide layer and the second silicon layer and communicating with the nozzle hole being formed,
a liquid chamber formed in the glass layer and communicating with the channel being formed, and
a liquid chamber layer provided in contact with the glass layer on a side thereof opposite to the second silicon layer and formed from a material different from that of the glass layer,
wherein the liquid chamber extends in the liquid chamber layer.

2. The nozzle plate according to claim 1, wherein
opening diameter of the channel is larger than opening diameter of the nozzle hole, and
opening diameter of the liquid chamber is larger than the opening diameter of the channel.

3. The nozzle plate according to claim 1, wherein a cover film is formed on an inner wall of the nozzle hole, and the cover film is made of a material having a higher affinity for liquid discharged from the nozzle hole than silicon.

4. The nozzle plate according to claim 3, wherein the cover film is made of oxide silicon.

5. The nozzle plate according to claim 3, wherein a water-repellent layer is formed on an outer surface of the first silicon layer, and the water-repellent layer is made of a material having a lower affinity for liquid discharged from the nozzle hole than the cover film.

6. The nozzle plate according to claim 1, wherein outlet-side opening diameter of the nozzle hole is equal to or less than inlet-side opening diameter of the nozzle hole.

7. The nozzle plate according to claim 1, wherein the bonding is anodic bonding.

8. The nozzle plate according to claim 1, wherein the channel has an opening shape which converges toward the nozzle hole.

9. A nozzle plate comprising:
a first silicon layer;
a glass layer;
a second silicon layer provided between the first silicon layer and the glass layer, the second silicon layer being bonded to the glass layer; and
a silicon oxide layer provided between the first silicon layer and the second silicon layer,
a nozzle hole passing through the first silicon layer and discharging a droplet being formed
a channel passing through the silicon oxide layer and the second silicon layer and communicating with the nozzle hole being formed,
a liquid chamber formed in the glass layer and communicating with the channel being formed, and
a liquid chamber layer bonded to the glass layer on a side thereof opposite to the second silicon layer and formed from a material different from that of the glass layer,
the liquid chamber extending in the liquid chamber layer,
wherein a cover layer is formed on a wall of the liquid chamber layer, the wall facing to the liquid chamber, and the cover layer is made of a material different from that of the liquid chamber layer.

10. A method for manufacturing a nozzle plate, comprising:
in a laminated body including a first silicon layer, a second silicon layer, and a silicon oxide layer provided between the first silicon layer and the second silicon layer, forming a nozzle hole passing through the first silicon layer;
forming a channel passing through the second silicon layer;
removing the silicon oxide layer exposed to bottom of the channel so that the nozzle hole communicates with the channel; and
anodic bonding the second silicon layer to a glass layer having a liquid chamber so that the channel communicates with the liquid chamber; and
wherein a plurality of the nozzle holes are formed, and adjacent nozzle holes are partitioned with the glass layer.

11. The method for manufacturing a nozzle plate according to claim 10, wherein silicon oxide is formed on an inner wall of the nozzle hole.

12. A droplet discharge head comprising:
a nozzle plate; and
pressurizing means for applying pressure to liquid in the liquid chamber,
the nozzle plate including:
a first silicon layer;
a glass layer;
a second silicon layer provided between the first silicon layer and the glass layer, the second silicon layer being bonded to the glass layer; and
a silicon oxide layer provided between the first silicon layer and the second silicon layer,
a nozzle hole passing through the first silicon layer and discharging a droplet being formed,
a channel passing through the silicon oxide layer and the second silicon layer and communicating with the nozzle hole being formed, and
a liquid chamber formed in the glass layer and communicating with the channel being formed, and
a plurality of the nozzle holes are provided, and adjacent nozzle holes are partitioned with the glass layer.

13. A droplet discharge apparatus comprising:
a droplet discharge head;
a driver for relatively moving an object and the droplet discharge head; and
a controller for controlling the droplet discharge head and the driver,
the droplet discharge head including:
a nozzle plate; and
pressurizing means for applying pressure to liquid in the liquid chamber,
the nozzle plate including:
a first silicon layer;
a glass layer;
a second silicon layer provided between the first silicon layer and the glass layer, the second silicon layer being bonded to the glass layer; and
a silicon oxide layer provided between the first silicon layer and the second silicon layer,
a nozzle hole passing through the first silicon layer and discharging a droplet being formed,
a channel passing through the silicon oxide layer and the second silicon layer and communicating with the nozzle hole being formed,
a liquid chamber formed in the glass layer and communicating with the channel being formed, and
a plurality of the nozzle holes are provided, and adjacent nozzle holes are partitioned with the glass layer.

14. A nozzle plate comprising:
a first silicon layer;
a glass layer;
a second silicon layer provided between the first silicon layer and the glass layer, the second silicon layer being bonded to the glass layer; and
a silicon oxide layer provided between the first silicon layer and the second silicon layer,
a nozzle hole passing through the first silicon layer and discharging a droplet being formed
a channel passing through the silicon oxide layer and the second silicon layer and communicating with the nozzle hole being formed,
a liquid chamber formed in the glass layer and communicating with the channel being formed, and
wherein a plurality of the nozzle holes are provided, and adjacent nozzle holes are partitioned with the glass layer.

* * * * *